US006083036A

United States Patent [19]

Wehrle et al.

[11] Patent Number: 6,083,036

[45] Date of Patent: Jul. 4, 2000

[54] MULTIPOLE CONNECTOR

[75] Inventors: Gerhard Wehrle, Donaueschingen; Rainer Strache, Weil im Schönbuch; Herbert Bohne, Bondorf, all of Germany

[73] Assignee: Coninvers Elektrotechnische Bauelemente, Germany

[21] Appl. No.: 09/154,269

[22] Filed: Sep. 16, 1998

[30] Foreign Application Priority Data

May 15, 1998 [DE] Germany ..... 198 21 858

[51] Int. Cl.[7] ..... H01R 13/62

[52] U.S. Cl. ..... 439/427

[58] Field of Search ..... 439/427, 428, 439/430, 445, 447

[56] References Cited

U.S. PATENT DOCUMENTS 4,593,962 6/1986 Knorreck et al. .

FOREIGN PATENT DOCUMENTS 4418259 8/1995 Germany .
830192 3/1960 United Kingdom .
1380351 1/1975 United Kingdom .

*Primary Examiner*—Neil Abrams
*Assistant Examiner*—Eugene G. Byrd
*Attorney, Agent, or Firm*—Bachman & LaPointe, P.C.

[57] ABSTRACT

A multipole connector for connecting a multipole-conductor cable comprising a cable receptacle and a connection piece, with the stranded conductors for axial contact of the free ends with assigned contact spikes of the connection piece being guided by axially parallel channels in the cable receptacle and being retained in the channels by clamping force by means of a coupling ring. The cable receptacle comprises a stranded-conductor mount for immovably fastening the stranded conductors and joining it, a terminal mounting, facing the connection piece. The stranded-conductor mount comprises a stationary fastening plate facing the terminal mounting, and a clamping plate movable in axial direction which when moving in the direction of the fastening plate, evenly and immovably clamps every stranded conductor against pulling movements. At least over the penetration length of the contact spikes into the channels, the terminal mounting is elastic in radial direction, in order to generate, by squeezing, even radial pressure at the circumference, for reliable contact, when the contact spikes are inserted, in all channels with matched channel diameter. This configuration makes it possible to construct a very short multipole connector where the number of stranded-conductor channels, and whether or not they are occupied, does not affect the clamping action. At the same time, clamping takes place in close proximity to the contact zone to prevent upsetting the stranded conductors in the channels. In addition, this configuration prevents flowing of the stranded-conductor insulation during insertion of the contact spikes through flexible channel walls on the one hand, and on the other hand permanent and even contact pressure on the compressed stranded conductors.

10 Claims, 2 Drawing Sheets

MULTIPOLE CONNECTOR

BACKGROUND OF THE INVENTION

The present invention relates to a multipole connector for connecting a multicore-conductor cable.

Such a connector is known from DE 44 18 259 C1. This connector comprises a distribution piece for accommodating the stranded conductors, a cable receptacle constructed from a grip piece and a cable screw-connection with pressure screw, as well as a contact support with contact spikes arranged in contact chambers and a coupling ring for attaching the cable receptacle at the connection piece formed at the distribution piece. The terminal part of the distribution piece facing the cable is of octagonal cross-section, with the eight plane sheath surfaces conically tapering off towards the free end. The interior contours of the part of the grip piece at the connection side is of a shape which matches the exterior contours of the terminal part of the distribution piece facing the cable. The distribution piece comprises four axially-parallel channels to accommodate unstripped stranded conductors, with the intermediate walls of two respective channels as well as the facing exterior walls between the channels and the respective sheath surfaces comprising slots. In this way, two springy exterior parts are formed which, when radial forces are experienced, render the terminal part facing the cable effective as a clamping area for the stranded conductors.

When assembling the connectors it is necessary to strip the ends of the stranded-conductor cables to a length which is somewhat longer than the length of the distribution piece. After inserting the stranded conductor, already slight clamping of the stranded conductors in the clamping area of the distribution piece should take place by means of the missing exterior parts; however, in practice, when assembling connectors, this is not adequate to prevent individual stranded conductors which have already been inserted from changing their positions and moving out of the channel. The configuration of the springy exterior parts by means of slots for clamping the stranded conductors always results in all the stranded conductors being clamped at the same time. Due to tolerances, this results in the clamping pressure on the stranded conductors not being evenly distributed. Even if a single stranded conductor is missing, this can significantly affect the clamping effect. On the one hand, clamping the stranded conductors relatively far from the contact zone makes it possible for the stranded conductors to slide back during the contact process, thus giving rise to the danger of a bad contact occurring. On the other hand it makes it possible that due to the kinking of the cable during the useful life of the connector, a stranded conductor may move in the direction of tension. Also if cables of different stranded-conductor cross-sections are used, a connector specially tailored for this becomes necessary. When inserting the contact spikes into the fronts of the stranded conductors, a slightly offset position or unfavorable tolerance position and the resulting high radial pressure can already result in a flow of the strands, which also has a significant negative influence on establishing reliable contacts.

It is thus the object of the present invention to overcome the above-mentioned disadvantages and to propose a connector for particularly fast and safe assembly, preferably of stranded-conductor cables with a high number of poles.

SUMMARY OF THE INVENTION

According to the invention, this object is met by the characteristics of the present invention.

The cable receptacle of the multipole connector comprises a stranded conductor mount to immovably fasten the stranded conductors and connected to it a terminal mounting, facing the connection piece, into which the contact spikes penetrate. The stranded-conductor mount comprises a stationary fastening plate facing the terminal mounting, and a clamping plate movable in axial direction which when moving in the direction of the fastening plate, evenly and immovably clamps every stranded conductor against pulling movements. At least over the penetration length of the contact spikes into the channels, the terminal mounting is elastic in radial direction, in order to generate, by squeezing, essentially even radial pressure at the circumference, in all channels, with matched channel diameter, when the contact spikes are inserted. The stranded conductors are individually guided in the clamping plate and can thus be secured against premature and unintentional pulling out when assembling other stranded conductors. By moving the clamping plate in the direction of the fastening plate, parallel but individual and even clamping of each strand occurs, thus making it immaterial whether all the channels provided in the connector are occupied by stranded conductors.

Connected to the fastening plate is an elastic terminal mounting which may be manufactured from an elastic plastic or rubber material. It is also possible to use respective terminal pieces of clamping tubes with a spring effect in radial direction, which are able to accommodate the radial pressure, and to clamp them to establish good contact with the contact spikes penetrating the front of the stranded conductors.

For assembly, the unstripped stranded conductors are led through the channels of the cable receptacle with the clamping plate and the fastening plate as well as the adjoining terminal mounting.

On its end facing the connection piece, the terminal mounting can comprise an end stop for the stranded conductors. When all stranded conductors are inserted, the clamping plate is moved along the stranded conductors in the direction of the fastening plate. In this way, the stranded conductors are clamped against all movement. Then the connection piece with the contact spikes is inserted into the channels of the terminal mounting, with the elastic design applying a respective even pressure in radial direction on the channels and thus on the strands.

This arrangement thus enables fast and safe assembly, with the independently operating stranded-conductor clamping system making it possible to have contact spaces of small as well as large dimensions. Any desirable pole configurations and numbers of stranded conductors are possible. Equally, various stranded conductor cross-sections in a tolerated cross-sectional range can be realised with a single stranded-conductor mount. Clamping of the stranded conductors takes place immediately in front of the contact zone, thus reducing the upsetting length of the stranded conductors in the contact zone to the smallest possible dimension, and preventing the stranded conductors from being pushed back during the contact process. The elastic terminal mounting maintains permanent contact pressure on the compressed strands. By virtue of their design and a respective elasticity module, the contact pressures can be applied in such a way that when the contact spikes are inserted into the contact zone, no material flows occur during insulation of the stranded-conductors which would have a lasting influence on contact pressure. In this way, a constant contact transition resistance lasting for an extended period of time can be ensured.

According to a further preferred embodiment, the terminal mounting is configured as an elastic pressure plate. In addition it is advantageously curved at its circumference. As a result, according to a further preferred embodiment, during insertion of the contact spikes into the channels of the pressure plate, the connection piece can compress the pressure plate at the circumference, to provide the required pressure in the channels and to ensure elimination of existing play between stranded conductors and channels, thus ensuring optimal contact and exact centring in relation to the contact spikes. Preferably, on the end facing the connection piece, the channels in the pressure plate are closed off by thin walls, to provide an end stop for the stranded conductors.

According to another embodiment of the invention, the elastic terminal mounting has been realised by springy terminal pieces of clamping tube which comprise a slot in longitudinal direction and are thus of C-shaped cross-section. These terminal pieces of clamping tube are connected to the fastening plate and act upon the stranded conductors or the strands and their insulation in correspondence with the pressure plate.

Due to the elastic retention of the stranded-conductor ends in the terminal mounting, there is the danger of upsetting and pushing back the stranded conductors. Thus, according to a preferred embodiment, the clamping plate comprises clamping spikes conically tapering off at their free ends and pointing in the direction of the fastening plate, for the stranded conductors which in the interior can be inserted in longitudinal direction of the spikes. To reduce the cross-section of the channels, the walls of the clamping spikes can be squeezed in radial direction; they fasten the stranded conductors in the area of the spike base and the spike tip, to prevent unintentional slipping out during assembly. When joined with the fastening plate, the conically configured ends of the clamping spikes move into a respectively configured recess in the fastening plate, which recess squeezes the spike tips, so that each stranded conductor is jammed individually and independently of the pressure acting onto other stranded conductors. The movement of the clamping plate along the stranded conductors results in parallel jamming of all stranded conductors. Thus jamming of the stranded conductors takes place as close as possible to the terminal mounting, thus precluding upsetting. In addition this results in a short cable receptacle and thus also a short connector.

According to a further embodiment, the clamping plate is steplessly connected and retained to the fastening plate, for example by means of a snap connection, bayonet connection or screw connection, in particular a coupling ring. During this connection, the clamping spikes are positioned in the recesses of the fastening plate. This results in a permanent jamming and securing of the stranded conductors being realised.

The cable receptacle and the connection piece are also steplessly connected, preferably by means of a snap connection, bayonet connection or screw connection, in particular a coupling ring. During this connection the fronts of the contact spikes are pushed into the stranded conductors leading to radial meeting of the pressure plate. In this way, pushing-in and pressing together can be carried out without any great force and permanent and secure contact can be realised.

According to a preferred embodiment, the snap connection, bayonet connection or screw connection which connects the connection piece and the cable receptacle, covers the snap connection, bayonet connection or screw connection which connects the clamping plate and fastening plate. This measure also contributes to the connector being kept short and provides an additional safeguard to clamping the stranded conductors in the cable receptacle.

BRIEF DESCRIPTION OF THE DRAWINGS

Below, the invention is further illustrated by means of the drawings showing exemplary embodiments, as follows.

DETAILED DESCRIPTION OF PREFERRED EMBODIMENTS

Figure 1:
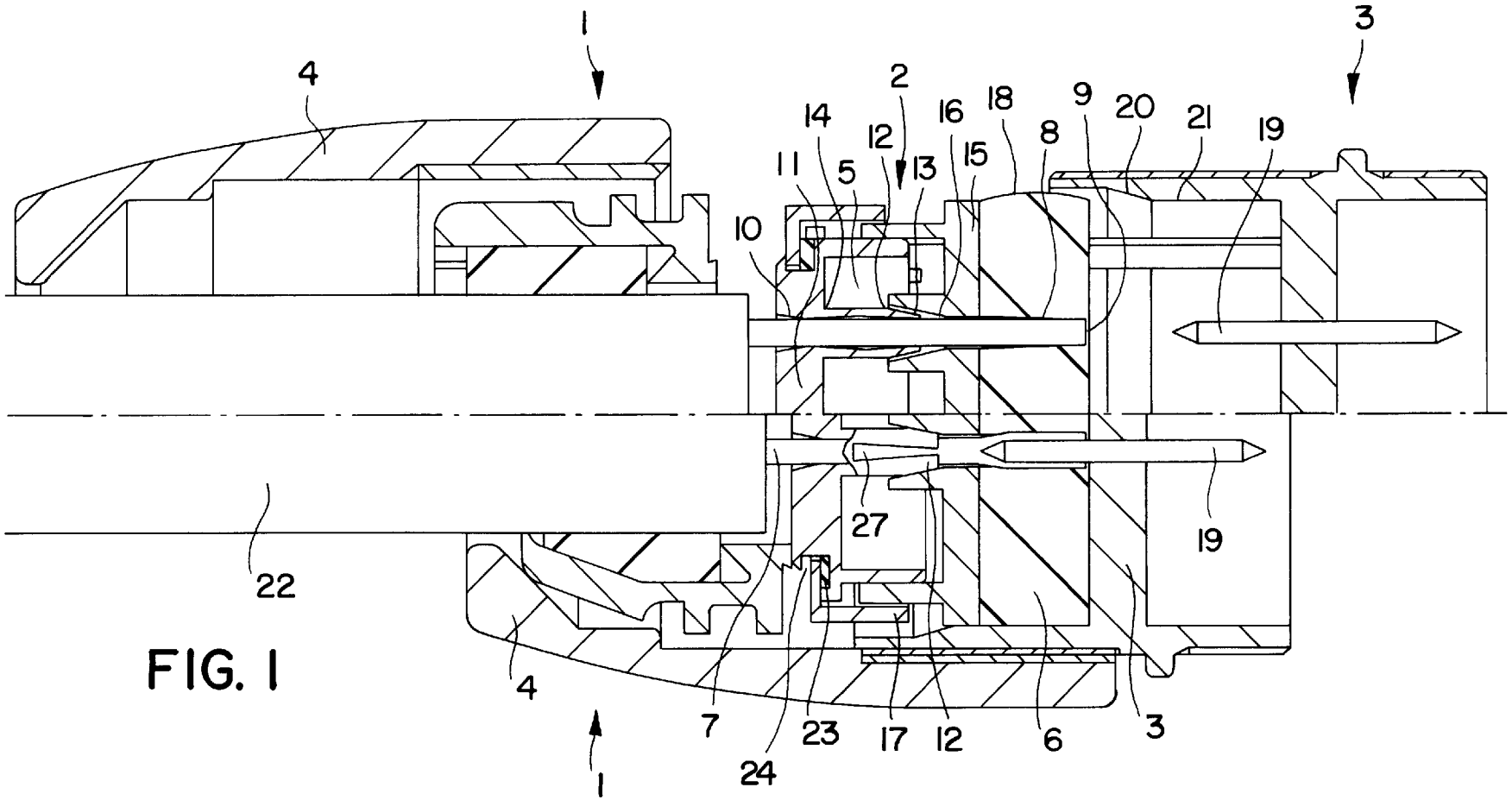
FIG. 1 is a longitudinal cross section through the connector with a pressure plate as an elastic terminal mounting.

The figures shows a longitudinal section through a multipole connector 1, with the upper half showing the connector 1 in an open state with stranded conductors 7 already inserted into the channel 8; and the lower half of the figures showing the connector 1 in a joined state. The connector 1 comprises a cable receptacle 2 and a connection piece 3 which are joined by means of a coupling ring 4. The cable receptacle 2 comprises a stranded-conductor mount and a flexible pressure plate 6 as a terminal mounting. For insertion of the individual stranded conductors 7 of a stranded-conductor cable 22, axially-parallel channels 8 are provided in the cable receptacle, into which channels the stranded conductors of the embodiment according to FIG. 1 are inserted up to an end stop 9 in the shape of a thin wall in the elastic pressure plate 6. It is also possible not to provide an end stop but instead to push the stranded conductors through and to cut them all to the same length. When inserting the stranded conductors 7 into the channels 8, the stranded conductors are first inserted by way of an lead-in funnel 10 into a movable clamping plate 11 of the stranded-conductor mount 5. The clamping plate comprises a plate with individual clamping spikes 12 provided with a longitudinal slot, which clamping spikes enclose the respective channel. The clamping spikes comprise thin walls and conically taper to points. The channel 8 in the interior of the clamping spikes 12 is made in such a way that the wall of the clamping spikes 12 in the region of the spike tip 13 and the spike base 14 easily fasten the inserted stranded conductor to prevent slipping back while other stranded conductors are assembled; while still enabling intentional pulling out. After the movable clamping plate 11, the stranded conductor reaches a fastening plate 15 of the stranded-conductor mount 5, which fastening plate is rigidly connected with the subsequent pressure plate 6. After this the stranded conductor reaches the pressure plate 6 up to the end stop 9. The fastening plate 15 comprises recesses 16 configured according to the exterior dimensions of the clamping spikes 12. When the clamping plate 11 is moved in the direction of the fastening plate 15, the clamping spikes 12 move into the said recesses 16. As a result, the stranded conductors 7 are clamped immovable against pulling out, in close proximity to the pressure plate 6, in the respective clamping spike 12, essentially over the entire length of the channel. The movement of the clamping plate 11 and the connection with the fastening plate 15 is stepless by means of a coupling ring 17. To counteract a reduction in the clamping effect as the stranded-conductor clamp gets older, a spring element 23, for example a wave washer, has been inserted between the coupling ring 17 and the clamping plate 11 of the stranded-conductor mount 5. With the coupling ring 17 in terminal position, this spring element 23, seen over an extended period of time, can carry out a readjustment movement within the gap dimension 24 in the direction of the fastening plate 15.

In the embodiment according to FIG. 1 the elastic terminal mounting is a pressure plate made from an elastic rubber material, comprising a convex surface curvature 18 at the circumference. When the cable receptacle 2 is joined with the connection piece 3 by means of coupling ring 4, the connection piece 3 with the contact spikes 19 is pushed into the front end of the stranded conductor 7, with the end stop 9 being penetrated by the point of the contact spike 19. In the known way, the contact spike 19 establishes contact with the strands in the stranded conductor 7 on the one hand, and on the other hand with the opposite end of the contact device with a respectively configured counterplug (not shown). During movement of the connecting piece 3, the edges 20 and 21 arranged at the interior circumference of the connection piece 3 compress the elastic pressure plate 6 in radial direction, so that the cross section of the channel adapts to the effective cross section of the inserted stranded conductor 7. At the same time, the contact spike 19 is pushed in, resulting in counter pressure from the inside in radial direction. This at the same time eliminates any differences in tolerance of the elastic pressure plate 6 and the entire play between the stranded conductor 7 and the respective channel 8. Also, the edge 20 causes the axial centers of the respective channels 8 to be exactly flush with the subsequently penetrating contact spikes 19. Subsequently the contact spikes 19 penetrate the ends of the stranded conductors 7 at the front to contact the cable cores. As a result, the ends of the stranded conductors bulge. The elastic pressure plate 6 exerts permanent contact pressure on the compressed stranded conductors 7. By configuring the material properties accordingly, no material flows occur during insulation of the stranded conductors in the contact zone, which would have a lasting influence on contact pressure.

Figure 2:
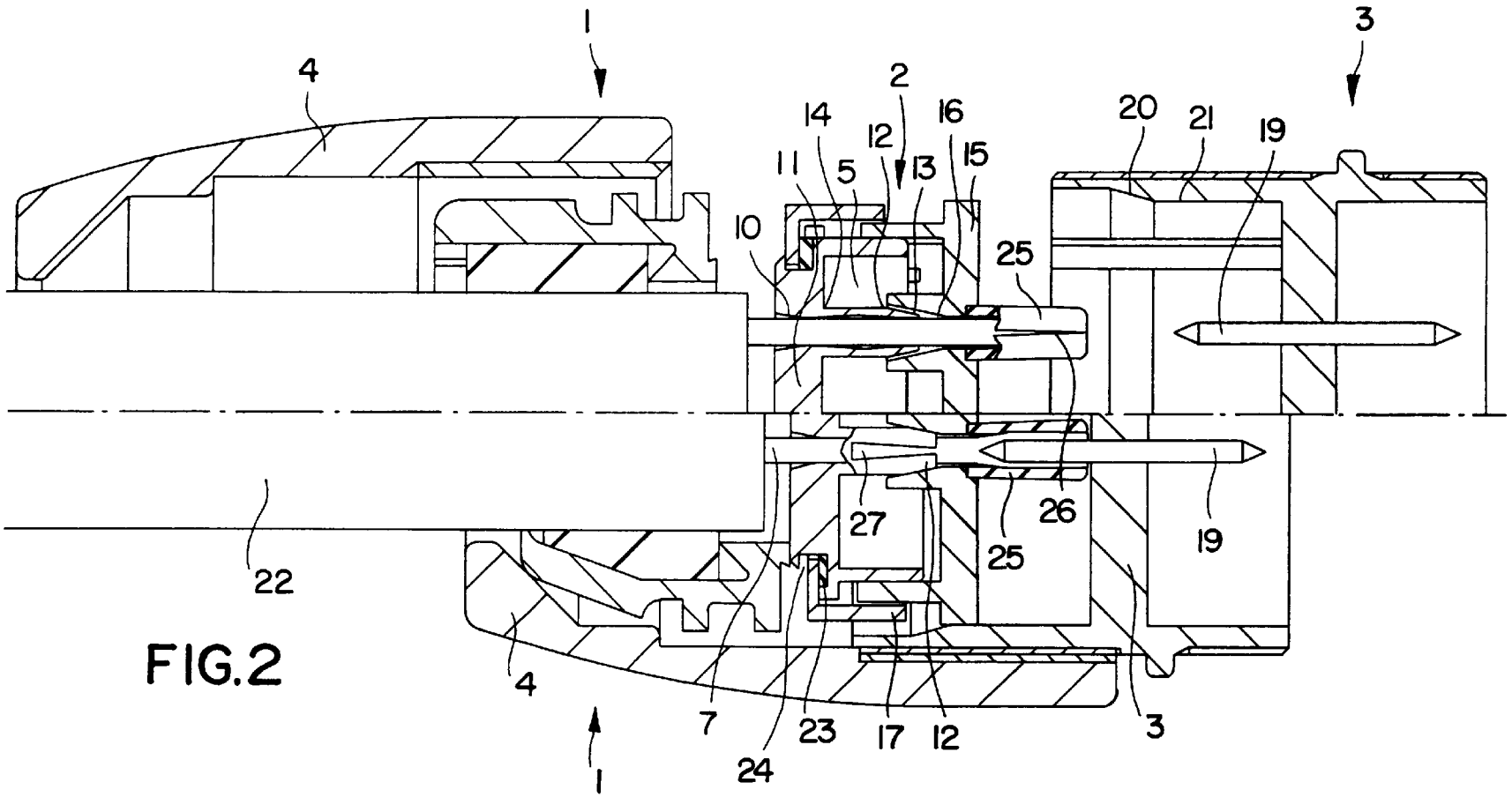
FIG. 2 is a longitudinal cross section through the connector with springy terminal pieces of clamping tube as an elastic terminal mounting.

In the embodiment according to FIG. 2, instead of the pressure plate 6 in the extension of channels 8 in the fastening plate 15 at the side facing the connection piece 3, terminal pieces of clamping tube 25 with spring action in radial direction are provided, with a longitudinal slot 26 as a terminal mounting. Their cross-section is C-shaped and they are enlarged when the contact spikes 19 are inserted. Here again, spring action results in adaptation to the required contact pressure while avoiding the flow during strand insulation and to compensate for tolerances.

By using an elastic terminal mounting according to FIG. 1 or FIG. 2, due to still inadequate fastening of the end of the stranded conductors, there is the danger of the stranded conductors 7 being pushed back when the contact spikes 19 are inserted. However, as can be seen in the figures, this is always prevented in that the stranded conductors with the clamping spikes 12 in the fastening plate are fastened very close to the contact area of the contact spikes 19 in the terminal mounting. The gap in the clamping area from the contact zone starting at the terminal mounting is reduced to the smallest possible dimension which is dictated by the minimum thickness of the fastening plate. This safely prevents the stranded conductors 7 from being pushed back during the contact process.

The configuration of the stranded-conductor mount 5 in the shape of a movable clamping plate 11 and a fastening plate 15 causes jamming of the stranded conductors 7 in parallel, but independently of each other as far as clamping pressure is concerned. As a result, the connector can comprise any number of channels, without the necessity of all channels being occupied by stranded conductors to ensure safe clamping of individual stranded conductors. Furthermore, this configuration of the stranded-conductor mount 5 makes it possible within a certain range to safely clamp stranded conductor cross-sections. Thus it is not necessary to provide separate cable receptacles with matching diameter for every diameter of stranded conductor.

As can be seen from the figures, in the assembled state the coupling ring 4 covers the cable receptacle 2 with its coupling ring 17 which connects the movable clamping plate 11 with the fastening plate 15. In this way a connector is provided which is easy to assemble and which is short when compared to the state of the art.

What is claimed is:

1. A multipole connector for connecting a multicore—conductor cable, comprising:

a cable receptacle and a connection piece and stranded conductors in said cable receptacle;

axially parallel channels in said cable receptacle for retaining said stranded conductors;

contact spikes of the connection piece for axial contact with free ends of said stranded conductors, said contact spikes being inserted in said axially parallel channels in said cable receptacle, wherein said contact spikes have a penetration length in said channels and in said conductors;

a terminal mounting at least in part surrounding said channels and facing said connection piece; and wherein said terminal mounting at least over the penetration length of the contact spikes into the channels and conductors, is elastic in a radial direction in order to generate, by squeezing, essentially even radial pressure around the inserted contact spikes at the circumference of said terminal mounting, for reliable contact in all channels between the contact spikes and conductors.

2. A connector according to claim 1, wherein said cable receptacle includes a stranded conductor mount adjoining said stranded conductors to immovably fasten said stranded conductors against pulling movements.

3. A connector according to claim 1, wherein the terminal mounting includes pieces of a clamping tube which are springy in a radial direction and which are of C-shaped cross-section.

4. A connector according to claim 1, wherein the terminal mounting is a pressure plate made from one of an elastic plastic and rubber material, wherein the terminal mounting includes axially parallel channels.

5. A connector according to claim 4, wherein said pressuring plate is squeezed at a circumference thereof by means of clamping elements of at least one of said cable receptacle and said connection piece, and wherein said channels clamp said stranded conductors after squeezing, thereby exerting radial contact pressure in all of the channels on the free ends of the stranded conductors, and wherein the axial centers of the channels is essentially aligned with the penetrating contact spikes.

6. A connector according to claim 2, wherein said stranded conductor mount includes a stationary fastening plate facing the terminal mounting, and a clamping plate moveable in an axial direction which when moving in the direction of the fastening plate evenly and immovably clamps said stranded conductor.

7. A connector according to claim 6, wherein the clamping plate includes clamping spikes having a spike base and spike tip, which spikes conically taper off at free ends thereof in the direction of the fastening plate, said clamping spikes fastening to the stranded conductors, wherein the spike tips during joining to the stranded conductor are moved to a respective recess in the fastening plate.

8. A connector according to claim 7, wherein the clamping plate is connected to the fastening plate by a stepless connection, and wherein the clamping spikes are positioned in the recesses of the fastening plate.

9. A connector according to claim 4, wherein the cable receptacle and the connection piece are connected by a stepless connection, with the connection resulting first in the circumferential compression of the pressure plate and then in the frontal penetration of the contact spikes into the stranded conductors.

10. A connection for connecting a multicore—conductor cable, comprising:

a cable receptacle and a connection piece and stranded conductors in said cable receptacle;

axially parallel channels in said cable receptacle for retaining said stranded conductors;

contact spikes of the connection piece for axial contact with free ends of said stranded conductors, said contact spikes being inserted in said axially parallel channels in said cable receptacle, wherein said contact spikes have a penetration length in said channels and in said conductors;

a terminal mounting at least in part surrounding said channels and facing said connection piece; and wherein said terminal mounting at least over the penetration length of the contact spikes into the channels and conductors, is elastic in a radial direction in order to generate, by squeezing, essentially even radial pressure around the inserted contact spikes at the circumference of said terminal mounting, for reliable contact in all channels between the contact spikes and conductors.

* * * * *